United States Patent [19]

Heybourn

[11] Patent Number: 4,605,117

[45] Date of Patent: Aug. 12, 1986

[54] CONVEYING ROD-LIKE ARTICLES

[75] Inventor: Frank Heybourn, Milton Keynes, England

[73] Assignee: Molins, Limited, Great Britain

[21] Appl. No.: 289,838

[22] Filed: Aug. 4, 1981

[30] Foreign Application Priority Data

Aug. 8, 1980 [GB] United Kingdom ..... 8025874

[51] Int. Cl.[4] ..... B65G 47/22

[52] U.S. Cl. ..... 198/493; 198/577

[58] Field of Search ..... 198/493, 577, 579, 955, 198/347, 633, 689; 406/84; 131/282, 283; 271/182, 195, 202; 414/903

[56] References Cited

U.S. PATENT DOCUMENTS

| | | | |
|---|---|---|---|
| 2,687,152 | 8/1954 | Hansel | 198/493 |
| 3,329,469 | 7/1967 | Stadelman | 198/493 |
| 3,623,598 | 11/1971 | Anfossi | 198/493 |
| 3,854,567 | 12/1974 | Poupin et al. | 198/689 |
| 4,147,247 | 4/1979 | Clarke | 198/577 |
| 4,311,229 | 1/1982 | Bennett | 198/493 |

*Primary Examiner*—Joseph E. Valenza
*Assistant Examiner*—Jonathan D. Holmes
*Attorney, Agent, or Firm*—Antonelli, Terry & Wands

[57] ABSTRACT

Rod-like articles, such as cigarettes, moving in a transverse stream are decelerated by directing air at the stream from adjustable vanes before the articles reach a slower moving stream formed in a transfer region. The arrangement may be used in a stack former in which a single-layer stream of articles is converted into a multi-layer stream.

13 Claims, 1 Drawing Figure

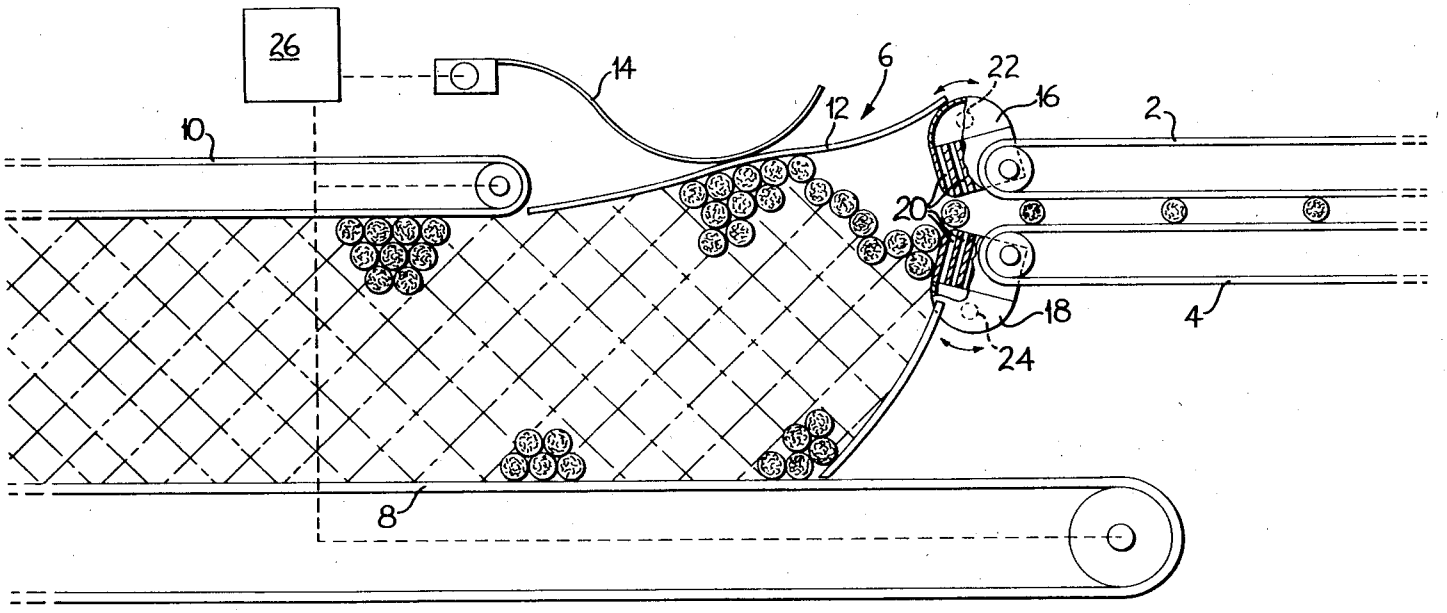
2
4
16
18
22
24
20
6
12
14
26
10
8

CONVEYING ROD-LIKE ARTICLES

In the tobacco industry it is common to convey rod-like articles such as cigarettes or cigarette filter rods between machines or parts of a machine in a direction transverse to their lengths. It has become increasingly common to convey articles in this manner in multiple-layer stacks, typically about twelve articles in depth. Stack forming apparatus in which a single-layer stream of transversely-moving articles is formed into a multiple-layer stream is already known, for example from British Patent Specification No. 1,453,191. Normally a stack of articles is formed from a single-layer stream of articles by reducing the conveying speed of the articles.

One aspect of the present invention provides a method of conveying rod-like articles in a stream in a direction transverse to the lengths of the articles, comprising the steps of reducing the conveying speed of the articles and reducing the mean distance between articles, wherein at least the speed change is at least partly effected by pneumatic means. Preferably the reduction in mean distance between articles is produced by said speed change and the height of the stream is increased by said speed change. Preferably also the flow rate before and after said speed change is substantially the same.

According to another aspect of the invention apparatus for conveying rod-like articles comprises a first conveyor for conveying a stream of articles in a direction transverse to the lengths of the articles at a first speed, a second conveyor for conveying a stream of articles in a direction transverse to the lengths of the articles at a second speed which is less than the first speed, a transfer region in which articles are transferred from the first conveyor towards the second conveyor, and means for directing an air flow to retard articles from said first conveyor in said transfer region.

If all articles from the first conveyor pass to the second conveyor the density of articles on the second conveyor is greater than that on the first conveyor since the latter conveys the articles more quickly. In a preferred arrangement the second conveyor conveys articles in multi-layer stack formation, and may comprise an endless band conveyor. The first conveyor, which may also comprise an endless band conveyor, may convey single-layer stream of articles, which articles may be spaced apart. The first conveyor could, however, convey a stack of articles.

Preferably the apparatus is incorporated in a stack forming device in which articles delivered from an article making machine in a single row are formed into a multiple-layer stack. In such an arrangement the speed difference between the first and second conveyor may be quite significant, since the first and second conveyors have substantially the same flow rate but on the former the articles may be spaced apart by several diameters and on the latter the articles are closely spaced in a stack several layers high. p The air flow directing means may be located at the end of the first conveyor and comprise opposed parts on opposite sides of the path from the conveyor; each part may comprise air directing vanes or channels in the transfer region. There may be a component of the air flow which tends to retard or decelerate the articles generally along the direction of transfer between the first and second conveyors. Such direction need not be parallel to the direction of conveyance on the first or second conveyors. The air flow my have a residual component or components which direct the articles in a particular direction or directions in the transfer region. Such other component or components may accelerate the articles. The air flow directing means may be adjustable to vary the direction of air flow from it.

In another aspect the invention extends generally to retarding transversely moving rod-like articles. By retarding transversely moving rod-like articles using air flow means rather than by allowing them to be slowed by eventual contact with a more slowly moving article or surface, more gentle retardation may be achieved; this is especially important for cigarettes, which are easily degraded or damaged by impact.

The invention will be further described, by way of example only, with reference to the accompanying diagrammatic drawing, which is a side view of apparatus for conveying filter cigarettes.

A single-row stream of spaced cigarettes moving in a direction transverse to their lengths is conveyed by upper and lower band conveyors 2, 4. Each of the upper and lower conveyors 2, 4 comprises laterally spaced bands which contact the cigarettes near their ends. The conveyors 2, 4 receive cigarettes from a final drum of a machine for assembling filter cigarettes, such as a Molins PA8, and deliver them to a transfer or stack forming region 6 over a stack conveyor 8. The conveyor 8 delivers the cigarettes in stack formation to further machinery, e.g. a tray filling device such as Molins Mark 16 VTFN or a cigarette packing machine such as Molins HLP4. Beyond the stack forming region 6 an upper conveyor 10 helps to control the stack on conveyor 8. A membrane 12 extends across the top of the region 6 and a pivoted sensor 14 rests on top of the membrane. The sensor 14 responds to changes of level in the region 6 and controls the speed of conveyors 8, 10 accordingly, e.g. so as to maintain the level of cigarettes in the region 6 substantially constant. A control means 26 is indicated diagrammatically in the drawing.

Adjacent the end of conveyors 2, 4 are upper and lower air manifolds 16, 18 each having a number of air directing channels 20. The channels 20 are arranged partly between the laterally-spaced bands of the conveyors 2, 4 and may have a transverse dimension of about three-quarters of the length of a cigarette. The channels 20 are angled so that there is a component of air flow in a direction opposed to that of transfer of articles from the conveyors 2, 4 into the stack forming region 6. Thus cigarettes passing from the conveyors 2, 4 are decelerated by an air flow before reaching the more slowly moving mass of cigarettes in the stack forming region 6.

The combined effect of the air flow may be merely to retard the cigarettes passing into the stack forming region 6. Alternatively, a residual component of the air flow may be used to direct cigarettes in a particular direction into the stack forming region. Thus the air flow from the channels 20 associated with the manifold 16 may differ (in intensity or direction) from that associated with the channels of the manifold 18 to produce a desired effect. The orientation of the channels 20 may be varied to produce a desired effect, e.g. by rotation of the channels and associated manifold 16 or 20 on respective mounting bearings 22 or 24 respectively.

I claim:

1. Apparatus for conveying rod-like articles, comprising means including a first conveyor for conveying a stream of articles in a direction transverse to the lengths of the articles at a first speed, means including a second conveyor for conveying a stream of articles in a direction transverse to the lengths of the articles at a second speed which is less than the first speed, the height of the stream on said second conveyor being greater than that on said first conveyor, a transfer region disposed between said first and second conveyors in which articles are transferred from the first conveyor towards the second conveyor, and means for directing an air flow to retard articles from said first conveyor in said transfer region as they move towards the second conveyor.

2. Apparatus according to claim 1, wherein the second conveyor is arranged to convey a multi-layer stack of articles.

3. Apparatus according to claim 2, wherein the first conveyor is arranged to convey a single layer stream of articles.

4. Apparatus according to claim 1, wherein the air flow directing means is located adjacent the end of the first conveyor.

5. Apparatus according to claim 4, wherein the air flow directing means includes opposed air flow emitting parts located so that articles from the first conveyor pass between said parts into the transfer region.

6. Apparatus according to claim 1, wherein the air flow directing means includes a plurality of air directing channels.

7. Apparatus according to claim 1, wherein the air flow directing means is arranged to produce a component of force on the articles in a first direction to retard the articles and a component of force in another direction.

8. Apparatus according to claim 1, wherein the air flow directing means is adjustable to vary the direction of air flowing from it.

9. Apparatus according to claim 1, including sensor means in said transfer region for detecting articles therein and for controlling the second conveyor.

10. Apparatus according to claim 1, including means for controlling at least one of said first and second speeds so that the flow rates of articles on said first and second conveyors are substantially the same.

11. Apparatus for conveying rod-like articles, comprising a first conveyor for conveying a single row stream of spaced articles in a direction transverse to the lengths of the articles at a first speed, a second conveyor for conveying a multi-layer stream of articles in a direction transverse to the lengths of the articles at a second speed which is less than the first speed, a transfer region in which articles are transferred from the first conveyor towards the second conveyor, including a region in which the articles are not under the influence of the first or the second conveyor, and means for directing an air flow to retard articles moving between the first and second conveyors in said region so that the speed of successive articles is reduced from said first speed to said second speed.

12. Apparatus according to claim 11, wherein the air directing means is arranged such that a substantial part of the reduction of the speed of the articles occurs upstream of the position at which the articles join said second stream.

13. Apparatus according to claim 12, wherein the articles have a downward component of movement in said transfer region.

* * * * *